US005165183A

United States Patent [19]

Huang

[11] Patent Number: 5,165,183

[45] Date of Patent: Nov. 24, 1992

[54] DISPOSABLE BIODEGRADABLE SANITARY SANDAL

[76] Inventor: David Huang, 9-1, Lane 161, Hsing An Road Sec. 1, Taichung, Taiwan

[21] Appl. No.: 679,606

[22] Filed: Apr. 3, 1991

[51] Int. Cl.[5] ..... A43B 3/12

[52] U.S. Cl. ..... 36/11.5; 36/9 A; 36/30 A; 36/84

[58] Field of Search ..... 36/84, 9 A, 9 R, 11.5, 36/30 A, 30 R, 28, 44, 25 R

[56] References Cited

U.S. PATENT DOCUMENTS

| | | | |
|---|---|---|---|
| 103,857 | 6/1870 | Ernst | 36/44 |
| 142,332 | 9/1873 | Gascoigne | 36/44 |
| 960,202 | 5/1910 | Sanderson | 36/30 A |
| 1,027,412 | 5/1912 | Fogelsong | 36/44 |
| 1,092,373 | 4/1914 | Long | 36/44 |
| 1,106,986 | 8/1914 | Stüki | 36/44 |
| 1,283,704 | 11/1918 | Ebner | 36/28 |
| 2,190,982 | 2/1940 | Gilbert et al. | 36/11.5 |
| 2,220,722 | 11/1940 | Langfelder | 36/9 A |
| 2,714,771 | 8/1955 | Olfene | 36/9 A |
| 2,803,894 | 8/1957 | Morgan | 36/11.5 |
| 2,926,434 | 3/1960 | Morgan | 36/11.5 |
| 2,971,278 | 2/1961 | Scholl | 36/11.5 |
| 2,978,817 | 4/1961 | Brenner | 36/11.5 |
| 3,221,422 | 12/1965 | Lemeshnik | 36/9 R |
| 4,571,851 | 2/1986 | Yamada | 36/11.5 |
| 4,747,219 | 5/1988 | Ammendolea | 36/28 |

FOREIGN PATENT DOCUMENTS

| | | | |
|---|---|---|---|
| 3032941 | 4/1982 | Fed. Rep. of Germany | 36/30 A |

*Primary Examiner*—Steven N. Meyers
*Assistant Examiner*—Thomas P. Hilliard

[57] ABSTRACT

A sanitary slipper type shoe comprising a sole and an upper. The sole having a top layer, a bottom layer, and a medial layer sandwiched between the two. The top layer has a corrugated, wave like upper surface, and the bottom layer has a rough lower surface. The medial layer is filled with dry plant materials obtained from agricultural waste and held together by an adhesive, thoroughly mixed with the plant material. A paper partition is centrally disposed within the medial layer and adheres to the filler on either side thereof. The paper sheet from which the bottom layer is composed extends outwards and wraps over the outer periphery of the medial layer to meet a lateral extension of the top layer, also made of paper sheet, which is wound over the sheet from the bottom layer in a tight an intimate to form a continuous seam around the top periphery of the sole. The paper upper is glued on its two ends to the respective left and right sides of the sole, near the toe area to complete the shoe.

2 Claims, 4 Drawing Sheets

DISPOSABLE BIODEGRADABLE SANITARY SANDAL

BACKGROUND OF THE INVENTION

The present invention relates to a slipper type shoe and more particularly to a disposable, sanitary slipper type shoe that is biodegradeable and non-polluting to the environment.

Environmental protection is a growing concern worldwide. Developed countries in Western Europe, North America, and Japan have a growing resistance to the usage of plastics for many articles. More and more, paper and other biodegradeable materials are replacing plastics in such everyday items as bags and containers.

On the other hand, the design, manufacture, and widespread use of disposable articles is also a worldwide trend. In particular, the use of foamed plastics, such as styrofoam, in such ubiquitous articles as containers, bowls, and, of course, slippers though offering the convenience of quick disposability, create serious environmental pollution problems.

Shoes are an item that are used by all peoples on a daily basis that also pose serious sanitary problems.

Particles of dead epidermis that naturally flake off from human skin or is rubbed out by friction with the shoe collect in the nooks and crevices of the shoe, which along with the warmth and sweat supplied humidity from a user's foot create a fertile cultivating ground for various micro-organisms.

Infectious pathogens that can easily infest and thrive inside a shoe often cause serious skin and foot diseases, especially in the case of shoes which often directly contact the skin of the user's foot, such as slippers and sandals. Broken skin on a user's foot is especially susceptible to infection which can lead to inflammation or more serious complications.

Though frequent washings may serve to keep shoes in sanitary condition, this is often inconvenient, time consuming, or impractical due to the shoe's design. It is for this reason that disposeable slippers have become common the home and are a practical necessity for public institutions such as hotels, lodges, and hospitals. In the case of the laqtter institutions having slippers repeatedly worn by different users would of course greatly complicate the sanitary problems mentioned above.

Nevertheless, it is often the case for sanitation conscious guests in a private home to be ill at ease when required to wear slippers offered by the host not knowing how often the slipper has been worm by ther. Even in a public domicile such as the hotels and lodges mentioned above, some patrons decline to wear the disposable slippers offered, fearing that cost conscious administraters may have simply re-issued them in an effort to reduce overhead.

The slipper type shoe of the present invention overcomes all these problems in providing a disposble slipper that is non-polluting to the environment, sanitary, and offers a way for a user to determine whether the slipper has been worn or not, due to its unique construction. Moreover, all this is obtained at a very low cost.

The slipper type shoe of the present invention is manufactured completely from natural organic materials that are biodegradeable. The bulk of the slipper consists of what are normally waste byproducts from argricultural related industries which accounts for its low cost. Disposed slippers may even be recycled.

SUMMARY OF THE PRESENT INVENTION

The slipper type shoe of the present invention has as a first objective to provide a slipper type shoe that is disposable and composed completely of natural biodegradeable materials derived from industry or argriculture that do not pollute the environment, and a second objective of providing a slipper type shoe that is both sanitary and provides a user with the ability to determine whether or not the slipper had previously been worn.

The slipper type shoe of the present invention comprises a sole and an upper.

The sole itself consists of a bottom layer, with a rough lower surface for better traction with the ground, a corrugated top layer, equivalent to an insole in a conventional shoe, and two filler layers, sandwiched between the bottom layer and top layer.

Both the top layer and bottom layer are made from high strength paper, which are of course biodegradeable.

Each of the two filler layers has a depth of filler of pre-determined thickness, over which a paper partition is glued. The upper surface of the paper partition of the upper filler layer in turn is glued with the lower surface of the corrugated top layer or insole.

The filler material itself consists of a mixture of dried plant material obtained from argricultural waste products, such as grain husk, and a natural, organic adhesive. The adhesive gives cohesion to the mass of plant matter and is used to attach the partitions and all the other paper components.

The hoop shaped upper is a loop of strengthened paper that is glued over the sole to its right and left sides, near the toe area.

As can be seen, all materials used in the structure of the slipper type shoe of the present invention are naturally derived, inexpensive, and completely biodegradeable. Thus, the first objective of the present invention is attained.

The paper top layer or insole mentioned above has a corrugated wave-like surface with a plurality of protruding crests and recessed troughs. This construction has a number of advantages.

First, skin particles and other detritus tends to collect in the recessed troughs and away from the skin of a user's foot which would largely rest over the protruding crests.

Secondly, after initial wear, noticeable deformation of the crests in some areas of the top layer would be a positive indication to a subsequent user of previous usage.

Also the gaps between the crests and attached partition below create numerous air ductrs that help cool the top layer, leading to greater user comfort and reduction of moisture due to perspiration from a user's foot.

The second objective of the present invention is thereby achieved.

A complete and full description of the the preferred embodiments of the slipper type shoe of the present invention is given below along with accompanying drawings.

PREFERRED EMBODIMENTS OF THE PRESENT INVENTION

Figure 1:
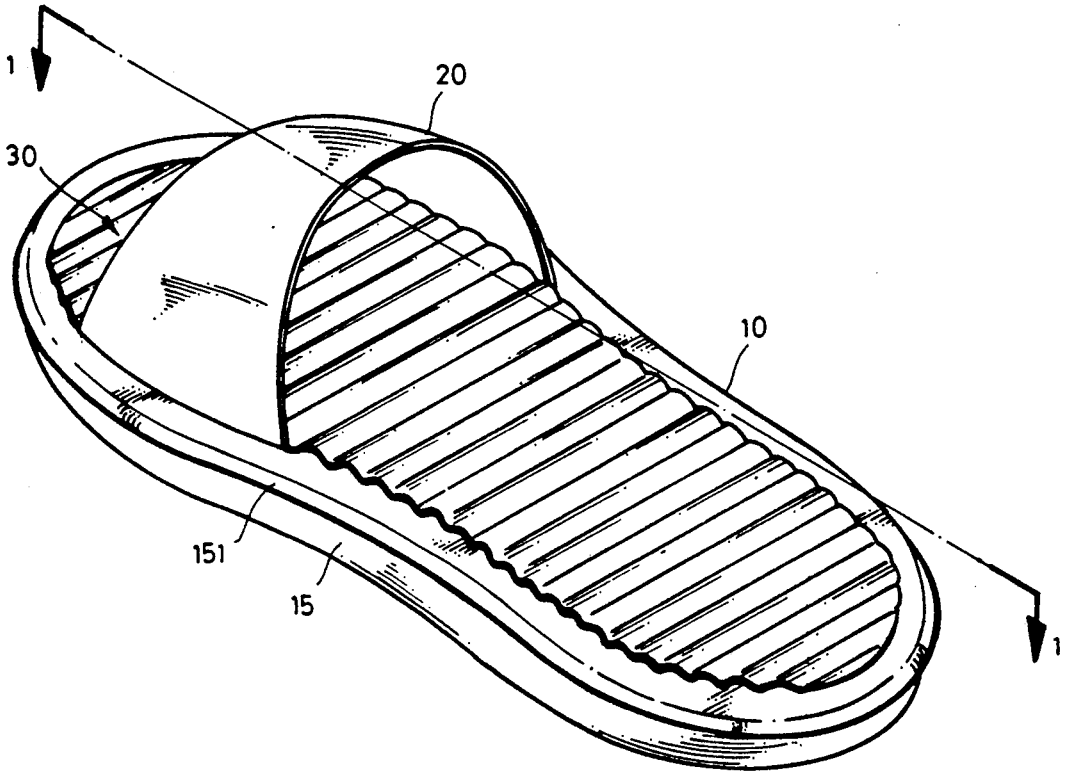
FIG. 1 is a perspective view of an embodiment of the slipper type shoe of the present invention.

Referring to FIG. 1, the shoe of the present invention comprises a sole 10 and an upper 20. Upper 20 is secured over the top of sole 10, near the toe area 30.

Figure 2:
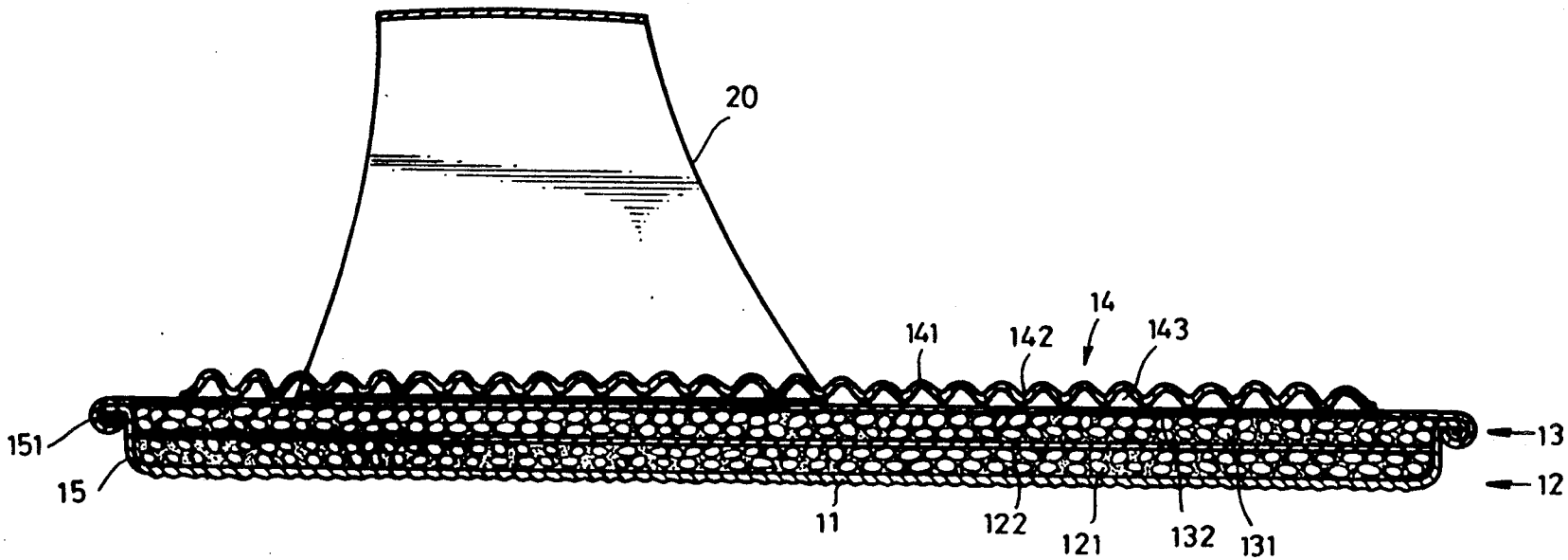
FIG. 2 is a sectional view of an embodiment of the slipper type shoe of the present invention, taken along line 1—1 of FIG. 1.

Sole 10 is constructed from several layers, as can be seen in the cross-sectional view of FIG. 2.

A bottom layer 11, manufactured from high strength paper board, is disposed at the bottom of sole 10. Bottom layer 11 is cut to the approximate shape of a human foot, as in all shoes. The lower surface of bottom layer 11 is coarse so as to increase its traction over a walking surface.

A first filler layer 12 and a second filler layer 13, both of a pre-determined thickness, are stacked above bottom layer 11. Each filler layer, 12 and 13, has a depth of filler 121 and 131, respectively. A pair of paper partitions 122 and 132 are disposed above respective fillers 121 and 131.

The filler material in layers 121 and 131 comprises a mixture of dried plant material and a naturally derived organic adhesive, both being derived from industrial or argricultural waste products. The adhesive gives cohesion to the mass of dried plant material and is also used to attach partitions 122 and 132 to respective layers 121 and 131.

The dried plant material used in the filler can come from a variety of sources. Grain husks are most suitable, and in this embodiment, the chaff from ground rice is used. Although other plant materials such as wood shavings or coconut husks can also be used.

A urea based adhesive, derived from animal urine, is used in this embodiment, but likewise other naturally derived glues may be used.

The composition of the filler layers 12 and 13 provides a high cushioning effect that greatly aids user comfort.

A top layer 14, made from corrugated paper, is adhesively attached to the top surface of partition 132 of second filler layer 13. Corrugated top layer 14 has a wavelike, alternating sequence of protruding crests 141 and recessed troughs 142 thereon. Crests 141 and troughs 142 extend laterally to the left and rigt sides of sole 10, perpendicular with the longitudinal axis thereof which extends from the toe area 30 to the rear heel area.

The undulating surface of top layer 14 offers better traction for a user's foot as compared to a flat surface, and detritus tends to collect in the recessed troughs 142, away from the skin of the user's foot to provide greater sanitation.

A plurality of air channels 143, defined by the space between the crests 142 and the surface of partition 132, allows air to flow under top layer 14 and provide a cool surface for the user's foot to contact, reducing sweat and offering a more comfortable and sanitary wear.

The arcuate crests 142 have a certain amount of bounce which provides a more pliant feel to the slipper in addition to the cushioning effect of the fillers.

More importantly, the crests 142 would be deformed to a certain extent upon initial wear. Thus a sanitation conscious user, upon visual examination of top layer 14 could immediately determine whether or not the slipper had previously been worn.

Moreover, the lateral corrugation of top layer 14 considerably increases the lateral rigidity thereof.

A surrounding rim 15 extends around the outer periphery of sole 10. Rim 15 is formed from an extension of the paper sheet of bottom layer 11 which extends upwards and around the first and second filler layers, 12 and 13, to meet with a lateral extension of partition 132 of the second filler layer 13. The extension of partition 132 then winds over and with the extension of bottom layer 11 to form a an intimate spiral seam 151 which extends continously around the top periphery of sole 10 to form an airtight seal.

Seam 151 forms a tight bond which insures the structural integrity of the slipper and prevents moisture from seeping into the filler layers, 12 and 13.

The upper 20 is formed from a hoop of paper whose left and right ends are sandwiched between top layer 14 and partition 132 of second filler layer 13, and held in place by an adhesive.

Though in this embodiment, two filler layers were provided, a single layer or additional layers could also be used to suit the needs of a user.

Also, the outer surfaces of bottom layer 11, rim 15, and top layer 14 can be coated with a thin protective layer of wax which greatly increases the slipper's resistance to water absorption.

Note that all parts of the slipper are manufactured from biodegradeable natural materials which do not pollute the environment when the slipper is discarded as refuse.

As the bulk of the slipper is composed of dried grain husks and adhesive derived from animal waste, the slipper is composed largely of recycled agricultural waste material, with a very low cost.

Both of the above mentioned qualities, low cost and environmentally safe materials, lead to a very ideal throw away slipper.

Figure 3:
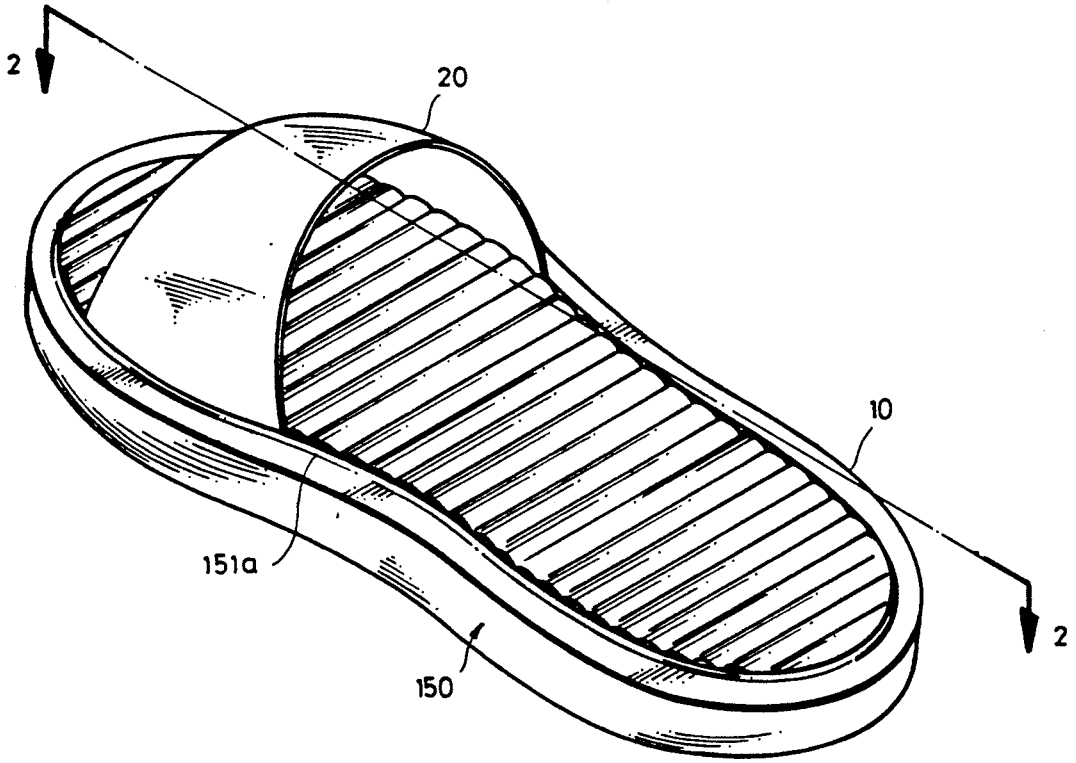
FIG. 3 is a perspective view of another embodiment of the slipper type shoe of the present invention.
Figure 4:
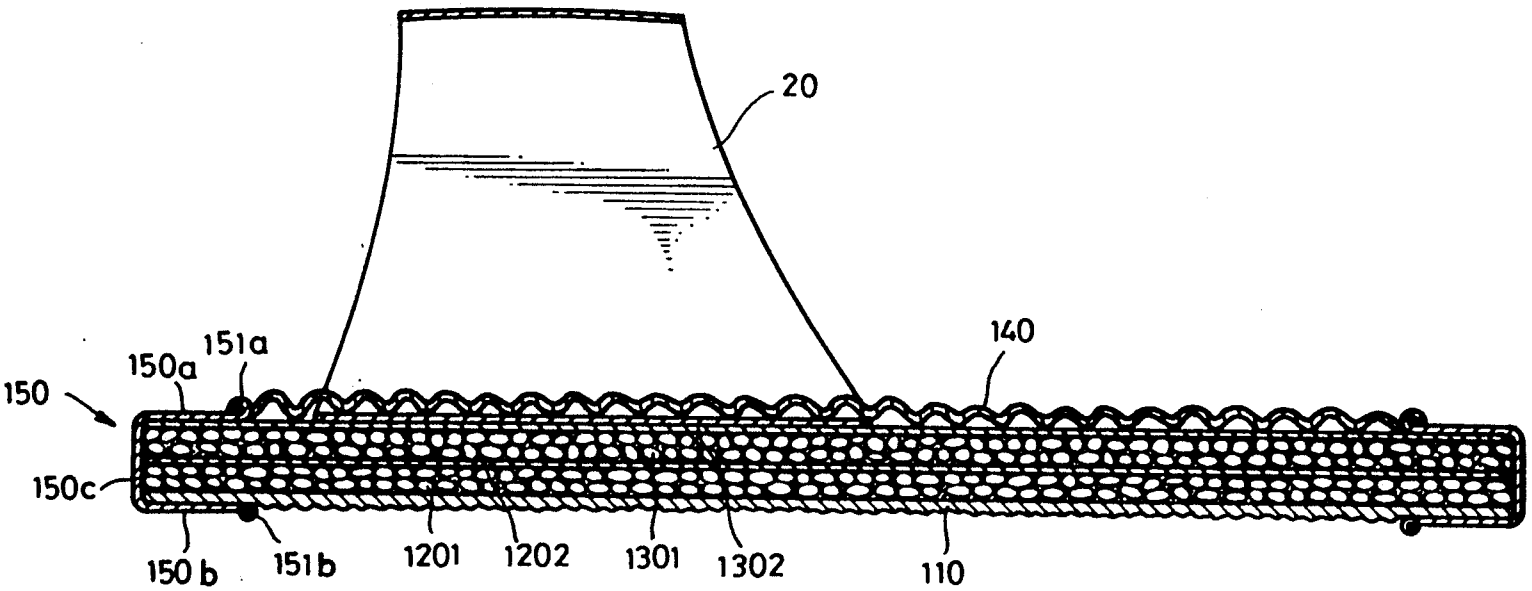
FIG. 4 is a sectional view of another embodiment of the slipper type shoe of the present invention, taken along line 2—2 of FIG. 3.

Referring to FIGS. 3 and 4, an alternative embodiment of the slipper of the present invention is also shown.

This embodiment is similar in structure with that previously described. A first and second filler layer with respective depths of filler 1201 and 1301, and respective partitions 1202 and 1302, are sandwiched between a bottom layer 110 and a corrugated top layer 140. An upper 200 is adhesively attached to the top surface of partition 1302, below top layer 140.

The difference lies in an elastic retainer frame 150, made from paper, replacing rim 15 of the previous embodiment. Retainer frame 150 is in the form of a loop with the approximate outline shape of the slipper. The loop has an upper border **150*a*, a parallel lower border 150*b*, and an outer periphery 150*c* joining the two borders, 150*a* and 150*b***.

Retainer frame 150 is fitted over the body of the sole, with upper border **150*a* and lower border 150*b* clamping and adhesively attaching to the outer peripheral areas of respective top layer 140 and bottom layer 110**.

The inner edges of upper border **150*a* and lower border 150*b* are curled into intimate spirals to form respective beads 151*a* and 151*b*** which extend around the periphery of the sole to increase the rigidity thereof.

I claim:

1. A shoe comprising a sole and an upper, wherein:

said sole comprises a top layer and bottom layer, made from a paper based sheet material, and a medial layer, said top and bottom layers being attached to respective upper and lower surfaces of said medial layer, with said bottom layer having a substantially rough lower surface so as to provide sufficient traction with a treading surface;

said medial layer comprises at least one partition made from a paper based sheet material and at least two layers of a filler, with each adjacent pair of layers of said filler having a said partition sandwiched therebetween;

said filler comprises a mixture of a naturally derived organic substance and a naturally derived organic adhesive, whereby said adhesive provides cohesion to said filler and causes said filler to adhere to said partition and said top and bottom layers;

said top layer includes a corrugated paper sheet, having an alternating sequence of protruding crests and recessed troughs defining a wavelike surface, adhesively attached over said partition on said medial layer, said crests and troughs of said corrugated paper sheet extending laterally to the left and right sides of said sole, in a direction roughly perpendicular with the longitudinal axis of said sole;

a rim, provided around the periphery of said sole, extends from said bottom layer to said top layer, forming a water tight seal around said sole;

said upper has two lateral sides which are secured on the respective left and right sides of said sole, near the toe area thereon, forming a hoop over said sole.

2. A shoe comprising a sole and an upper, wherein:

said sole comprises a top layer and bottom layer, made from a paper based sheet material, and a medial layer, said top and bottom layers being attached to respective upper and lower surfaces of said medial layer, with said bottom layer having a substantially rough lower surface so as to provide sufficient traction with a treading surface;

said medial layer comprises at least one partition made from a paper based sheet material and at least two layers of a filler, with each adjacent pair of layers of said filler having a said partition sandwiched therebetween;

said filler comprises a mixture of a naturally derived organic substance and a naturally derived organic adhesive, whereby said adhesive provides cohesion to said filler and causes said filler to adhere to said partition and said top and bottom layers;

a rim, provided around the periphery of said sole and forming a water tight seal therearound, comprises a retainer element in the form of a loop with roughly the same outline shape as said sole and having a U shaped cross section, with sufficient elasticity so as to be wrappable over the outer periphery of said sole, said retainer element having an upper border, a lower border substantially parallel with said upper border, and an outer periphery adjoined with the outer peripheral edges of said upper border and said lower border, wherein said retainer element is wrapped over said sole with said upper border and said lower border clamping and adhesively to the peripheral portions of respective said top layer and said bottom layer of said sole, said medial layer of said sole being surrounded by said outer periphery of said rim, and the inner edges of respective said upper border and said lower border being curled into an intimate spiral, forming continuous beads extending around the respective top and bottom of said sole in proximity to the outer periphery thereof and serving to reinforce the rigidity of said sole;

said upper has two lateral sides which are secured on the respective left and right sides of said sole, near the toe area thereon, forming a hoop over said sole.

* * * * *